US007394474B2

(12) United States Patent
Taraci

(10) Patent No.: US 7,394,474 B2
(45) Date of Patent: Jul. 1, 2008

(54) METHOD AND APPARATUS FOR IMPLEMENTING AN OVERLAY CURSOR AND ASSOCIATED SCOPE TRIGGER IN A VIDEO TEST GENERATOR

(75) Inventor: Brian Taraci, Foothill Ranch, CA (US)

(73) Assignee: RGB Systems, Inc., Anaheim, CA (US)

( * ) Notice: Subject to any disclaimer, the term of this patent is extended or adjusted under 35 U.S.C. 154(b) by 737 days.

(21) Appl. No.: 10/840,689

(22) Filed: May 6, 2004

(65) Prior Publication Data

US 2005/0209802 A1 Sep. 22, 2005

Related U.S. Application Data

(60) Provisional application No. 60/554,128, filed on Mar. 17, 2004.

(51) Int. Cl.
*G09G 5/00* (2006.01)

(52) U.S. Cl. ..... 345/904; 345/204; 345/157

(58) Field of Classification Search ..... 345/904, 345/204, 157

See application file for complete search history.

(56) References Cited

U.S. PATENT DOCUMENTS 5,387,925 A * 2/1995 Melling et al. ..... 345/440.1
6,483,503 B1 * 11/2002 Spannaus et al. ..... 345/213

* cited by examiner

*Primary Examiner*—Richard Hjerpe
*Assistant Examiner*—Leonid Shapiro
(74) *Attorney, Agent, or Firm*—The Hecker Law Group, PLC

(57) ABSTRACT

A method and apparatus for implementing a video test generator having an overlay cursor and an associated scope trigger are presented. A user interface permits a user to move a cursor across a displayed image, and to select a scope trigger point in the analog video stream based on the location of the cursor in the displayed image. Video waveforms associated with particular image pixels of interest or groups of pixels are observed on an oscilloscope by placing the cursor over the subject pixels or pixels on the video display and using the derived scope trigger to time the capture of the video waveform on the oscilloscope. The cursor is generated by tracking the horizontal and vertical position of the cursor, and altering or substituting out the video signal where the pattern of the cursor should appear.

3 Claims, 4 Drawing Sheets

METHOD AND APPARATUS FOR IMPLEMENTING AN OVERLAY CURSOR AND ASSOCIATED SCOPE TRIGGER IN A VIDEO TEST GENERATOR

CROSS REFERENCE TO RELATED APPLICATIONS

This application claims priority from U.S. Provisional Application No. 60/554,128 filed on Mar. 17, 2004, the specification of which is herein incorporated by reference.

BACKGROUND OF THE INVENTION

1. Field of the Invention

This invention relates to the field of electronic video apparatus, and, more specifically, to electronic video test equipment.

2. Background Art

Electronic systems of all kinds require testing for various reasons, such as experimental evaluation, product benchmarking, system certification or verification, and troubleshooting. In the case of video equipment, such testing can be complicated by the one-dimensional transmission mechanism (e.g., streaming analog or digital video) and the two-dimensional display mechanism. Often a test engineer will view a test image on a video display to identify visually apparent degradations in the displayed image. The test engineer may then attempt to trigger an oscilloscope to capture the corresponding portion of the streaming video signal for analysis. Existing mechanisms for triggering the oscilloscope are imprecise and rely on visual guesswork by the test engineer. These problems may be better understood from a general description of video, as provided below.

Video equipment operates on a continuous input stream of data, commonly in the form of distinct color signals or channels (such as R (red), G (green), and B (blue)) or as a single gray-scale signal (equivalent to R, G and B signals having the same values with respect to time) for black and white video. Along with the analog video data, a vertical sync (synchronization) signal and a horizontal sync signal are transmitted to facilitate rasterizing of the stream of video data into a two-dimensional array of values (i.e., "pixels") that form an image on a display device, such as an analog video monitor. The vertical sync signal indicates when a new image frame should begin (e.g., return to the top-left pixel of the video monitor), and the horizontal sync signal indicates when the display device should begin the next row of pixels.

Like all electrical signals, video signals are subject to the frequency response characteristics of every device or conduit through which the signal is transmitted. One significant effect of the combined system frequency response is that higher frequency components of the signal degrade as the signal passes through cables and video equipment, resulting in distorted display behavior.

For example, a display device may have a scan rate of 40 MHz, which will support image frequencies up to 20 MHz. At 20 MHz, the video signal is swinging between two signal values at each consecutive pixel (i.e., appearing as horizontal stripes that are one pixel wide). If the video signal is passed through a device or conduit that has a roll-off frequency of 17 MHz, for example, signal frequencies near and above 17 MHz will be attenuated. This attenuation causes a reduction in the magnitude of the signal swing at those frequencies that may be visible as a graying or muting of the image intensity in the horizontal stripes described above.

Test engineers that wish to examine this sort of distortion behavior may display an image that contains those high frequency components to look for distortion in the image. Once a distorted location is found, the test engineer may view the corresponding portion of the video signal in an oscilloscope to evaluate the transient response of the system and to determine the level of attenuation where the distortions occur.

However, only a small portion of the video stream is viewable in the oscilloscope display. Therefore, the test engineer attempts to trigger the oscilloscope to capture the video signal as close to the distortion point as possible. In many cases, this means making an educated guess as to the horizontal scan line in which the distortion occurs, and then setting the oscilloscope to trigger on the horizontal sync signal for that scan line. The test engineer must then scroll the display of the oscilloscope to find the location of interest. If the test engineer's scan line guess was inaccurate in the first place, the test engineer will have to make another guess and reset the oscilloscope to trigger on the new horizontal sync signal.

The above method for viewing a desired portion of a video signal on an oscilloscope is time consuming and frustrating for the test engineer. Many engineer man-hours are wasted each year on this awkward testing process, at great expense to the testing company. For this reason, it would be desirable to have a more accurate and efficient method for establishing a scope trigger near a point of distortion in a displayed image.

SUMMARY OF THE INVENTION

The invention is a method and apparatus for implementing a video test generator having an overlaid cursor mechanism for selecting a scope trigger point. Embodiments of the invention may provide a video test signal for simultaneous viewing as a two-dimensional image on a video display and as a streaming waveform on an oscilloscope. The video test signal delivered to the video display may contain an overlaid cursor signal, the position of which may be determined by a user through a user control interface. In addition, the apparatus may provide a trigger signal to test equipment (e.g., an oscilloscope) to initiate capture of a portion of the video waveform associated with the location of the cursor on the displayed two-dimensional test image.

In accordance with one or more embodiments of the invention, the video test signal may be generated within the apparatus of the invention. The apparatus may also generate a pixel clock, a vertical sync signal and a horizontal sync signal. The video test signal may be converted from digital into analog form for transmission to the system under test, and ultimately to a video display and oscilloscope. A pixel substitution circuit may be implemented in digital form prior to the digital-to-analog conversion, or in analog form subsequent to the digital-to-analog conversion. The pixel substitution circuit operates to replace the video test signal with a cursor signal at points in the video test stream corresponding to a pixel location of the cursor. The cursor may include a single pixel or a pattern made up of multiple pixels (e.g., a cross-hair pattern).

In another embodiment of the invention, the video test signal may originate from an outside source. In this embodiment, the video signal from the outside source may already have an associated vertical sync signal. The apparatus may be phase-locked to this vertical sync signal to generate a pixel clock for a specified video resolution. The video signal from the outside source may be passed through a pixel substitution circuit, which substitutes the desired overlay pattern into the video signal prior to transmission of the video signal to the display device. The scope trigger may then be generated based on the derived pixel clock and the location of the cursor.

DETAILED DESCRIPTION

The present invention is a method and apparatus for implementing a video test generator having an overlay cursor and an associated scope trigger. In the following description, numerous specific details are set forth to provide a more thorough description of the present invention. It will be apparent, however, to one skilled in the art, that the present invention may be practiced without these specific details. In other instances, well known features have not been described in detail so as not to obscure the present invention.

Embodiments of the invention may be implemented within a video testing system in which an oscilloscope is used to view the transient characteristics (e.g., voltage vs. time) of a video test signal passed through a system under test and input to a video display. It is in this video testing context that embodiments of the invention will be described herein. However, the method and apparatus of the invention may be used in other applications as well, without departing from the scope of the invention.

The present invention provides a video testing apparatus with the ability to present a cursor overlaying the video signal. The position of the cursor may be tracked by the apparatus of the invention, and manipulated by a user via a user interface. By positioning the cursor at a desired point in the video frame, the user may select a trigger point in the video signal at which the oscilloscope initiates display of the signal. The test signal may be generated by the video test generator itself, or by an external source.

1. The Video Test Setup

Figure 1:
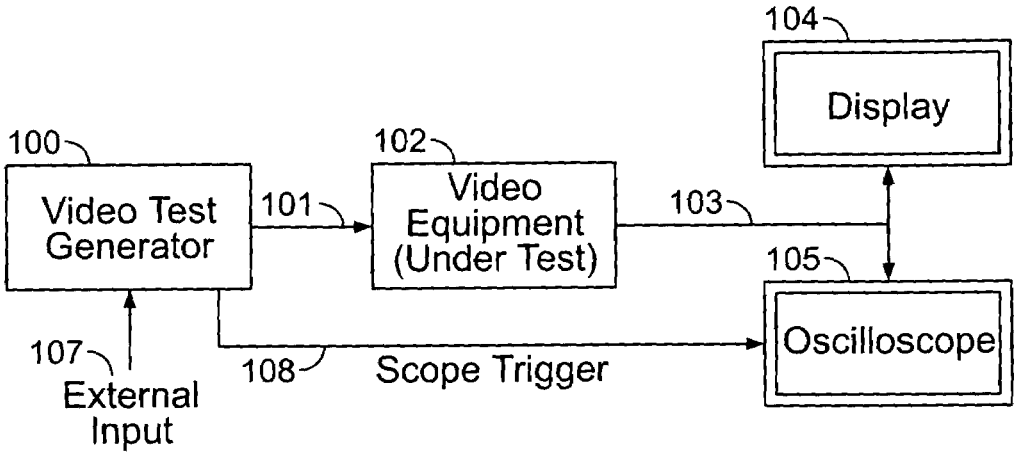
FIG. 1 shows a video test set-up in accordance with one or more embodiments of the invention.

FIG. 1 illustrates an example test setup in which embodiments of the invention may be used. Video test generator 100 represents an embodiment of the apparatus of the invention. Video test generator 100 is equipped with an external video input through which an external video signal may be input to the test setup. The test signal 101 with the overlaid cursor is transmitted from video test generator 100 into video equipment 102 (i.e., the system under test). The video output 103 from video equipment 102 is transmitted to display 104 and to oscilloscope 105. (If display 104 is the only device under test, then video equipment 102 is omitted.)

Test signal 101 is generated without distortion; however, video signal 103 bears the frequency response effects of video equipment 102. A test engineer viewing display 104 may visually identify those frequency response effects in the displayed two-dimensional test image. The test engineer can then use controls on a user interface of video test generator 100 to position a cursor at the location of a visible distortion in the image. Using the cursor position as an index within the image frame, video test generator outputs a pulse on scope trigger signal 108 when the indexed point of the video signal is transmitted. Oscilloscope 105 is then able to capture the video signal using the timing of the scope trigger pulse. Further, by using the scope trigger as another signal input into the oscilloscope, the test engineer knows exactly where the transient of interest is, because the scope trigger pulse will be lined up in time with the transient.

2. Video Test Generator Circuit

Figure 2:
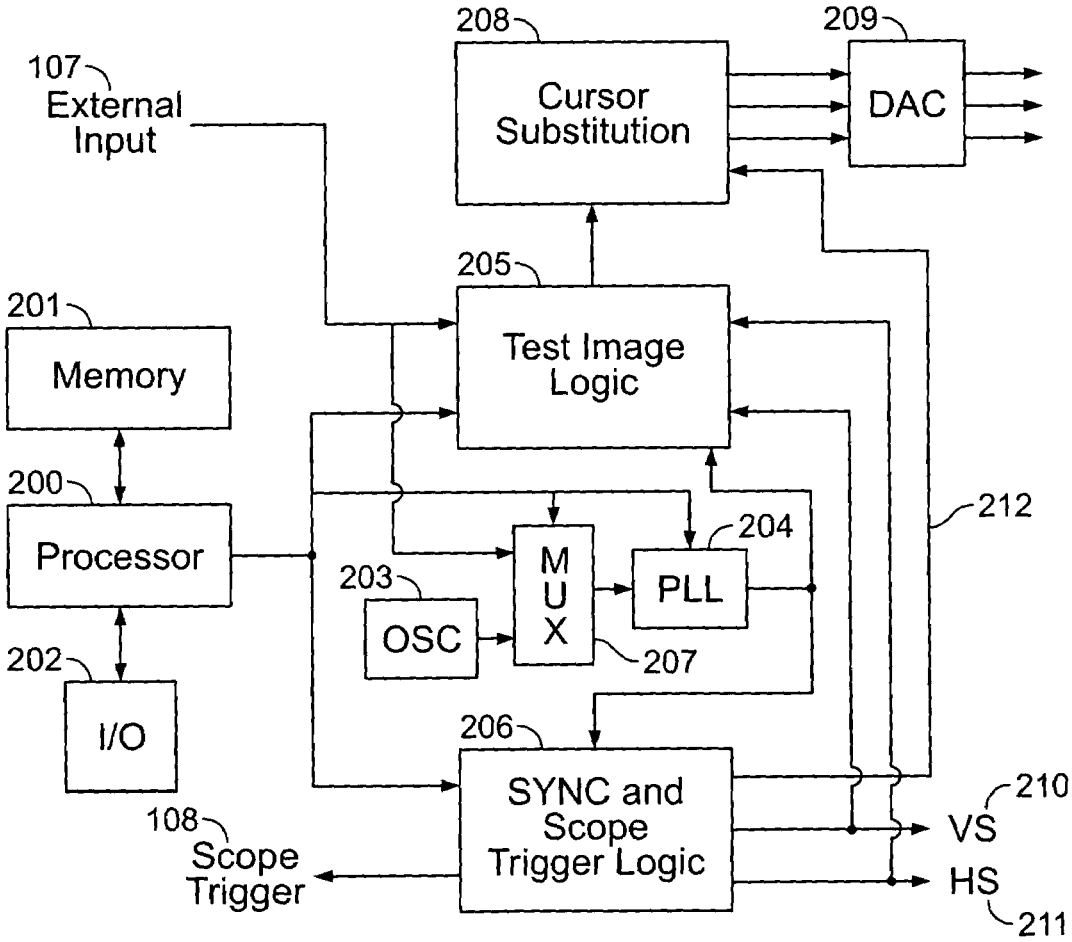
FIG. 2 is a block diagram of a video test generator in accordance with one or more embodiments of the invention.

FIG. 2 is a block diagram of a video test generator circuit in accordance with one or more embodiments of the invention. The video test generator includes a processor (200) having associated memory (201) and an input/output interface (I/O 202). Memory 201 may include random access memory (RAM), flash memory, erasable-programmable read-only memory (EPROM), and/or any other storage means. I/O 202 may include, for example, a keypad, an LCD screen, and any other user interface mechanism. Processor 200 may execute instructions stored in memory 201 to support the user interface provided by I/O 202, and to control the other logic elements within the video test generator. Much of the remaining logic (i.e., elements 203-208) may be implemented, for example, in an ASIC (application specific integrated circuit) or an FPGA (field programmable gate array).

Oscillator (OSC) 203 provides the clock reference for phase-locked loop (PLL) 204 when test image logic 205 is generating the test image. PLL 204 includes a programmable clock multiplier to determine the relationship between the pixel clock rate and the oscillation frequency of OSC 203. Processor 200 communicates with PLL 204 to program the clock multiplier based on, for example, the scan rate given specified frame dimensions of the test image.

When the test image is provided externally, the vertical sync signal from the external image source, as received via external input 107, may be used as the reference clock for PLL 204. Processor 200 selects the appropriate reference clock for PLL 204 by controlling multiplexer 207. The pixel clock is transmitted to test image logic 205 and sync and scope trigger logic 206.

Sync and scope trigger logic 206 is configured by processor 200 (e.g., with the number of pixels in a scan line and the number of lines in a frame) to provide vertical (VS) sync signal 210 and horizontal (HS) sync signal 211 from the pixel clock. Further, processor 200 passes cursor movement information, received via controls on I/O 202, to sync and scope trigger control logic 206 to update stored cursor position information. For example, user input may be transmitted to sync and scope trigger logic 206 to increment and decrement a pixel register/counter and a line register/counter, which together identify the current cursor position.

Further, when a user selects a scope trigger point, e.g., by pressing a button on I/O 202, processor 200 may trigger the copying of the cursor pixel register/counter and line register/counter into a trigger point pixel register and line register. Multiple trigger point register pairs may be provided to permit multiple trigger locations to be identified at a time. Input received through I/O 202 may be used to have processor 200 select a current trigger point from those that are stored.

Sync and scope trigger logic 206 also provides cursor signal 212 to cursor substitution circuit 208. Cursor signal 212 is high (or low) when the pixel and line value of the video stream cross the cursor pattern centered on the cursor "position" (e.g., when the rasterized video stream would cross the vertical portion of a cross-hair cursor).

Processor 200 may configure test image logic 205 to use a test image streamed through external input 107, a test frame or frames stored in memory 201 that are converted into a continuous video stream, or test image logic 205 may generate a streaming test pattern in real time using pattern generation logic within test image logic 205. The pattern generation logic may use vertical and horizontal sync signals 210 and 211, and/or test pattern parameters set by processor 200 to determine the ratio and resolution of the desired test pattern. The selected test image is streamed out in digital form through cursor substitution circuit 208.

Cursor substitution circuit 208 passes the streaming video data (e.g., as three separate color channels) through to digital-to-analog converter (DAC) 209. However, when cursor signal 212 goes high, cursor substitution circuit 208 swaps one pixel of data with the data value selected to represent the cursor on the display. This cursor data value may be fixed, it may be selectable via the user interface of I/O 202, or it may be logically determined based on the data being removed (e.g., pick the cursor color that provides the most contrast with the removed data).

DAC 209 converts the digital data channels passed by cursor substitution circuit 208 into analog data channels. The output of DAC 209 is provided to the output port of the video test generator.

3. The Cursor Generator

Figure 3:
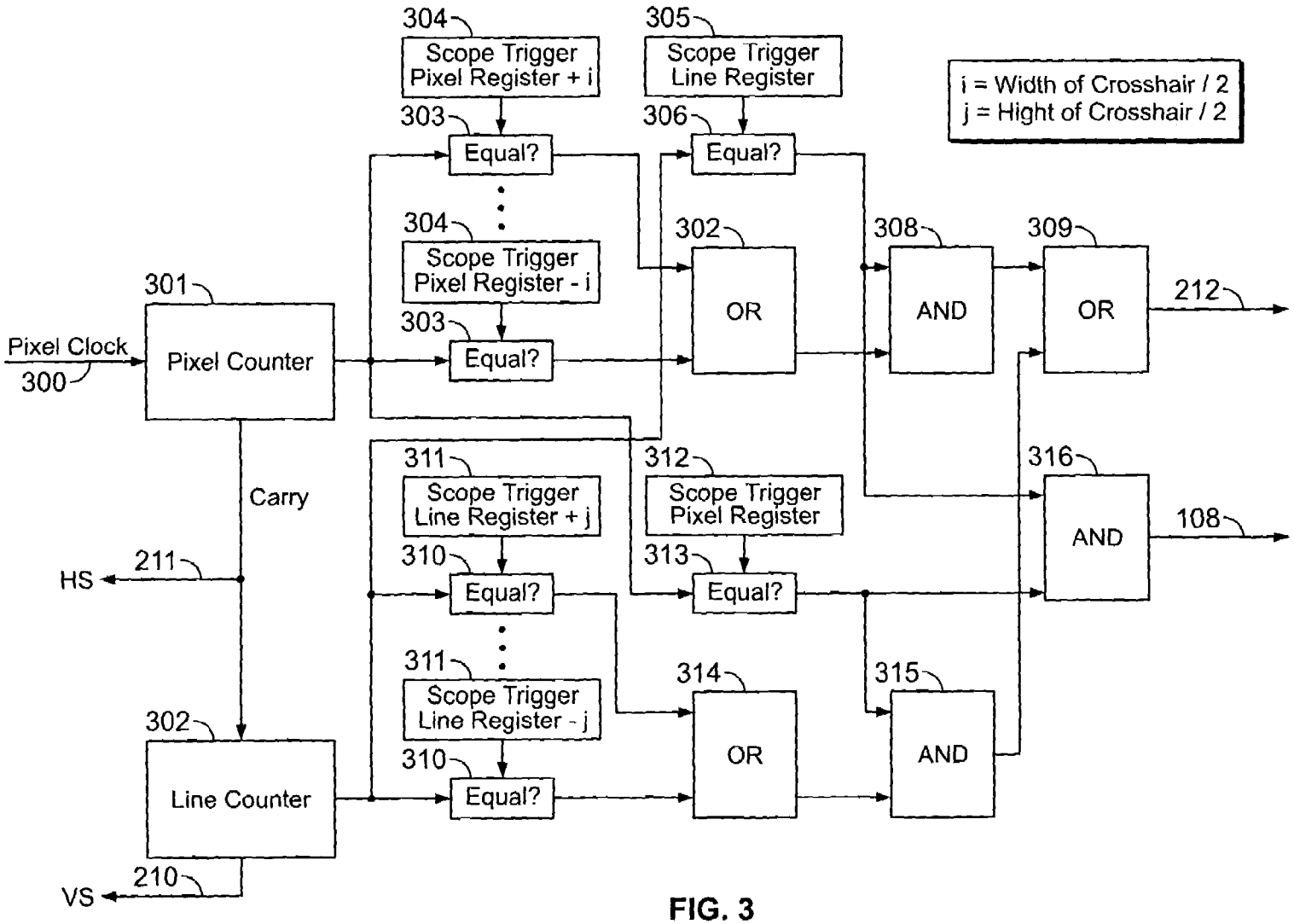
FIG. 3 is a block diagram of a cursor generator circuit in accordance with an embodiment of the invention.

FIG. 3 is a block diagram of crosshair generator and scope trigger circuit in accordance with an embodiment of the invention. The logic shown may be implemented within block 206 of FIG. 2.

In FIG. 3, the pixel clock (300) is used to clock pixel counter 301. The value stored in pixel counter 301 represents the horizontal pixel position (from left to right) of the video data being generated (or passed through) at any given moment. When pixel counter 301 reaches a value corresponding to the end of a scan line, pixel counter 301 resets itself and clocks line counter 302. The value corresponding to the end of a scan line may be configurable by processor 200, either in response to user input or in response to an executed program. The signal used to clock line counter 302 may also be used as the horizontal sync signal 211.

Line counter 302 is clocked by HS 211, as stated above. The value stored in line counter 302 represents the vertical pixel position (from top to bottom, typically)) of the video data being generated (or passed through) at any given moment. When line counter 302 reaches a value corresponding to the end of a frame, line counter 302 resets itself on the next clock (end of line) and outputs vertical sync signal VS 210. The value corresponding to the end of a frame may be configurable by processor 200, either in response to user input or in response to an executed program.

There are two general conditions in which the crosshair cursor pattern is crossed by the raster scanner: (1) when the raster scanner crosses the vertical crosshair, and (2) when the raster scanner crosses the horizontal crosshair. Different logic implementations may be used to determine whether the current pixel and line value rests on the cursor pattern.

FIG. 3 illustrates an embodiment wherein each pixel location of the cursor pattern is compared with the pixel location represented by pixel counter 301 and line counter 302. Such an exhaustive approach will work for any cursor pattern. However, it will be clear that some logic optimizations may be possible for different cursor patterns, resulting in an equivalent circuit with fewer logic components.

To determine whether the horizontal component of the crosshair is being crossed, the embodiment of FIG. 3 compares the value stored in pixel counter 301 with each of the horizontal pixel locations of the horizontal crosshair, i.e., the value stored in the cursor pixel register as well as those pixel locations extending to the left and right for "i" pixels ("pixel register−i", . . . , "pixel register", . . . , "pixel register+i"). Pixel registers 304 hold the horizontal pixel values, and comparators 303 determine whether any of the values in pixel registers 304 match the value in pixel counter 301. The outputs of comparators 303 are OR'ed together in OR gate 307. The value in cursor line register 305 is compared in comparator 306 with the value in line counter 302, to determine whether the current scan location is vertically aligned with the horizontal crosshair. The output of OR gate 307 and comparator 306 are coupled to AND gate 308. When the output of AND gate 308 is high (i.e., "true"), then the current scan location is on the horizontal crosshair.

To determine whether the vertical crosshair is crossed by the current scan location, line registers 311, containing line values plus or minus "j" pixels from the value in the cursor line register, are compared (in respective comparators 310) with the value in line counter register 302. The outputs of comparators 310 are coupled to OR gate 314, the output of which is further coupled to AND gate 315. In comparator 313, the value from cursor pixel register 312 is compared with the value in pixel counter 301 to determine whether the scan location is horizontally aligned with the vertical crosshair. The output of comparator 313 is provided to AND gate 315. When the output of AND gate 315 is high (i.e., "true"), then the scan location is currently on the vertical portion of the cursor. As the scan location only has to be on either the horizontal crosshair or the vertical crosshair, the outputs of AND gates 308 and 315 are provided to OR gate 309. The output of OR gate 309 is the cursor pattern signal 212 provided to cursor substitution block 208.

When the outputs of comparators 306 and 313 are true, this means that the scan location is currently on top of the center of the cursor, matching with both the cursor pixel register and the cursor line register. Therefore, when the outputs of comparators 306 and 313 are provided to AND gate 316, the output of AND gate 316 is the scope trigger output 108.

In some embodiments of the invention, when the cursor is over the desired location, the test engineer provides input to the video test generator (e.g., presses a button on I/O 202) causing the video test generator to store the pixel and line values for the selected location into a pair of trigger registers. Those trigger registers may then be compared with pixel counter 301 and line counter 302 to create scope trigger signal 108. With this selection mechanism, the cursor does not need to remain over the pixel location of interest. Rather, the cursor may be moved aside, so as not to interfere with the signal viewed on the oscilloscope.

In an alternate embodiment, the 2i+1 registers 304 may be replaced by two registers containing the end values of the horizontal crosshair, i.e., "pixel register−i" and "pixel register+i". When the scan location matches "pixel register−i", a flip-flop is set high, representing the fact that the current scan location is horizontally aligned with the horizontal crosshair. The flip-flop is reset when the scan location no longer matches "pixel register+i", i.e., when the scan location is no longer horizontally aligned with the horizontal crosshair. The flip-flop, in effect, replaces OR gate 307. A similar flip-flop may be used with respect to the vertical alignment of the scan location with the vertical crosshair.

Figure 4:
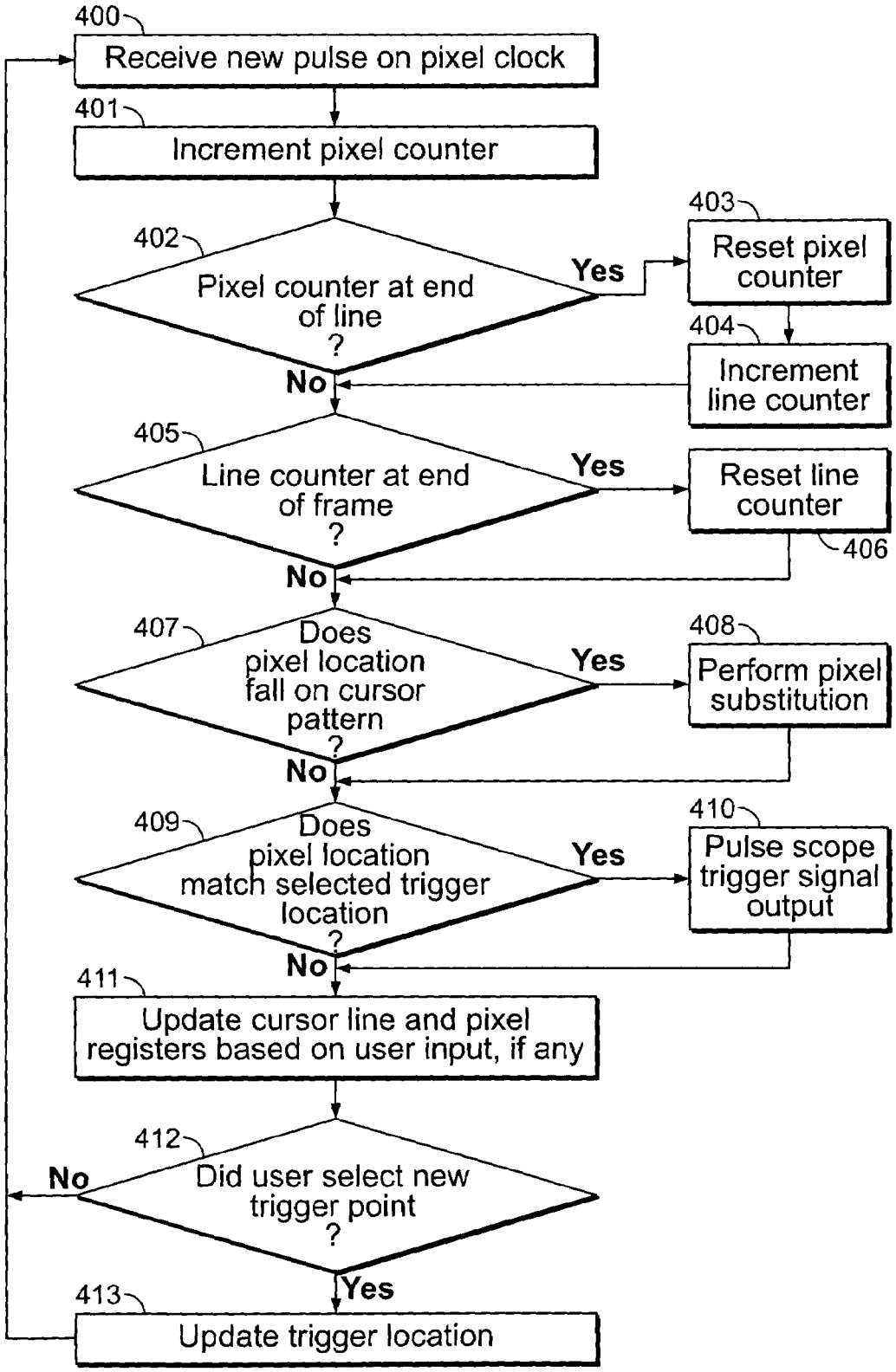
FIG. 4 is a flow diagram of a process for overlaying a cursor and providing a scope trigger, in accordance with one or more embodiments of the invention.

FIG. 4 is a flow diagram illustrating a process for overlaying a cursor pattern on a video signal and generating a scope trigger signal, in accordance with an embodiment of the invention. The process shown may be implemented in hardware, software or a combination of hardware and software. The implementation shown is synchronized to the pixel clock, though some process blocks (e.g., 411-413) may be implemented asynchronously in other embodiments. Also, the relative order of the enumerated blocks may differ in some embodiments (e.g., blocks 407-408 may be performed after blocks 409-410), and some blocks may be performed in parallel.

In block 400 of FIG. 4, a new pixel display interval begins, triggered by a pulse on the pixel clock. In block 401, the pixel counter, which tracks the current column position of the rasterized video stream in the display frame, is incremented by one. Note that in one or more alternate embodiments, a coarser cursor and scope trigger control may be implemented by incrementing in units of pixel blocks, e.g., incrementing a three-pixel block counter on every third pixel clock. The pixel block size may be implemented as a user-programmable parameter, for example.

In block 402, if the pixel counter value is at the end of a line of pixels, then, in blocks 403 and 404, respectively, the pixel counter is reset and the line counter is incremented by one. In block 405, if the line counter is at the end of the frame, then the line counter is reset in block 406.

In block 407, the process determines whether the current pixel location, as represented by the current values in the pixel and line registers, falls on the cursor pattern. As discussed with respect to FIG. 3, this typically includes performing multiple comparison operations between the pixel counter and the cursor pixel register (plus or minus offsets for the cursor width), and the line counter and the cursor line register (plus or minus offsets for the cursor height). If the current pixel location lies on the cursor pattern, then, in block 408, pixel substitution is performed within the video stream to draw the cursor.

In block 409, the current pixel location is compared to the selected scope trigger location (e.g., represented by pixel and line register values loaded during a previous user selection input). If the current pixel location matches the trigger location, then, in block 410, a pulse is generated on the scope trigger signal output.

In block 411, the cursor pixel and line registers may be updated to reflect a new position in accordance with user input. In some embodiments, the pixel and line registers may be independently controlled by the user, such that the user moves a full-frame vertical line (based on the line register value) to a desired horizontal position and then moves a fill-frame horizontal line (based on the pixel register value) to a desired vertical position, or vice versa. The intersection of the two lines may then represent the current cursor position.

In block 412, if the user selects a new trigger point during the current pixel interval, then the trigger location registers are updated with the current cursor location register values in block 413. As mentioned previously, multiple sets of trigger location registers may be provided in some embodiments, allowing the user to store multiple trigger points at any one time. The user may then select one of the stored trigger locations as the "active" trigger that the above process uses to provide scope trigger pulses.

The process of FIG. 4 may repeat from block 400 at the next pixel interval.

4. Cursor-Based Testing Method

Figure 5:
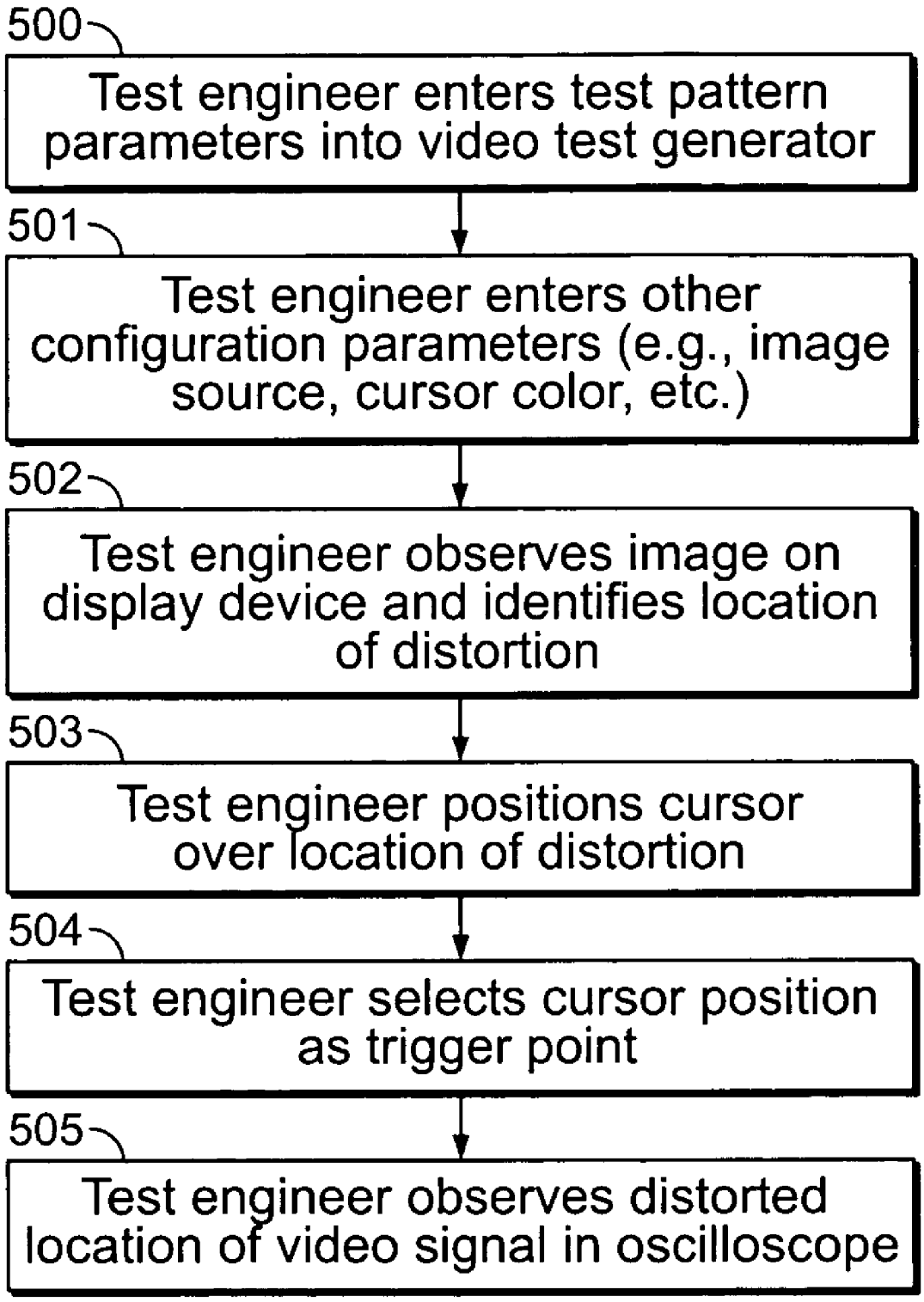
FIG. 5 is a flow diagram of a process for testing video devices in accordance with an embodiment of the invention.

FIG. 5 is a flow diagram of a process for testing video devices in accordance with an embodiment of the invention. The following process assumes a test setup similar to that shown in FIG. 1. The process steps need not be undertaken in the order shown.

In FIG. 5, at step 500, the test engineer configures the video test generator for the desired display device, inputting parameters such as desired test pattern frame dimension. In step 501, additional configuration parameters may be input into the video test generator, such as test pattern source selection, cursor color, etc.

In step 502, the test engineer observes the test pattern on the display device and identifies a location of visual distortion. The test engineer may then move the cursor on the display screen to the location of the visual distortion, in step 503. This cursor movement is accomplished through input devices on the video test generator. With the cursor over the distortion, in step 504, the test engineer selects the pixel location as a scope trigger point, e.g., by pressing a button on the video test generator. In some embodiments, the test engineer may select multiple locations on the display and choose between those stored locations via a user interface on the video test generator. The video test generator then provides a scope trigger for the selected location. In step 505, the test engineer views the video signal in the oscilloscope to evaluate the transient behavior of the signal at or near the trigger location.

Thus, a method and apparatus for implementing a video test generator having an overlaid cursor mechanism for selecting a scope trigger point, have been described. Particular embodiments described herein are illustrative only and should not limit the present invention thereby. The invention is defined by the claims and their full scope of equivalents.

What is claimed is:

1. A method for providing a scope trigger comprising:

tracking a raster location, wherein tracking said raster location comprises:

incrementing a pixel counter based on a pixel clock;

resetting said pixel counter at the end of a raster line;

incrementing a line counter at the end of said raster line; and resetting said line counter at the end of a frame;

updating a cursor location based on user input;

substituting a cursor pixel into a video stream of pixels when said raster location lies on a cursor pattern referenced to said cursor location;

selecting a trigger location based on said updated cursor location; and generating a trigger pulse when said raster location matches said selected trigger location.

2. The method of claim 1, wherein said raster line and said end of frame are integer values based on a selected frame resolution.

3. The method of claim 1, wherein updating said cursor location comprises:

receiving a horizontal control signal;

modifying a pixel register value based on said horizontal control signal; receiving a vertical control signal; and modifying a line register value based on said vertical control signal.

* * * * *